United States Patent [19]

Schwartz

[11] Patent Number: 4,484,181

[45] Date of Patent: Nov. 20, 1984

[54] TRAVEL BURGLAR/SMOKE ALARM

[75] Inventor: Frederic W. Schwartz, Providence, R.I.

[73] Assignee: Cable Electric Products, Inc., Providence, R.I.

[21] Appl. No.: 369,445

[22] Filed: Apr. 19, 1982

[51] Int. Cl.[3] ..... G08B 19/00; G08B 13/08

[52] U.S. Cl. ..... 340/521; 340/546; 340/586; 200/61.7; 116/77; 116/DIG. 44

[58] Field of Search ..... 340/521, 541, 545, 546, 340/586; 200/61.03, 61.62, 61.7, 61.73; 116/75, 77, 86, 100, 214, DIG. 44

[56] References Cited

U.S. PATENT DOCUMENTS

| | | | |
|---|---|---|---|
| 3,768,086 | 10/1973 | Powell et al. | 340/546 |
| 3,878,539 | 4/1975 | Gooding | 340/546 |
| 4,227,188 | 10/1980 | Petersen | 340/546 |
| 4,258,359 | 3/1981 | McLamb | 340/546 |
| 4,264,899 | 4/1981 | Menzies et al. | 340/546 |

*Primary Examiner*—Donnie L. Crosland
*Attorney, Agent, or Firm*—Paul J. Sutton

[57] ABSTRACT

A portable apparatus for use by a traveler whereby the traveler is able to protect himself from unauthorized entry through a preselected door and simultaneously protect himself from a fire occuring in the room where the portable apparatus is located.

6 Claims, 6 Drawing Figures

22
26
28
24
19
20
21
17
18
16
2
2
10
12
14

TRAVEL BURGLAR/SMOKE ALARM

BACKGROUND OF THE INVENTION

FIELD OF THE INVENTION

This invention relates to security alarms in geeral and specifically to a combined door alarm and smoke alarm.

PRIOR ART

Door alarms are a common item with many versions available on the market. Most door alarms are designed to mount on the door jamb or door in the approximate vicinity of the door handle. Most of them are capable of being shut off if the door, once opened, is then quickly shut. The present invention is provided with a latching circuit so that when the door to which it is attached is opened, the alarm is not capable of being turned off unless the unit is reset.

Smoke alarms for travelers are also common. If a traveler wishes to be protected from either a burglar who might enter by a door, or a fire occuring in the room, he must carry two separate alarms. The present invention provides for a single unit which is capable of protecting the traveler from a forced entry and/or fire. Further prior art units so not provide an indication of their location during a fire. In addition the present invention is located at the top of a door in a position which is unobstrusive.

SUMMARY OF THE INVENTION

An object of the present invention is to provide a dual purpose portable alarm;

Another object of the present invention is to provide for a portable alarm which mounts on the top edge of a door;

Yet another object of the present invention is to incorporate a smoke detector for fire detection purposes;

Still another object of the present invention is to provide a source of light on the alarm which can be used to locate the door during a fire;

Still yet another object of the present invention is to fit doors of varying thickness;

A further object of the present invention is to sense the door movement when the door is opened and to continue the alarm even if the door is then closed.

My invention will be made more clearly understood from the following description of specific embodiments of the invention, together with the accompanying drawings.

DESCRIPTION OF THE PREFERRED EMBODIMENT

The travel alarm of the present invention is comprised of a portable housing containing a smoke alarm and an entry alarm. The travel alarm is attached to the top of the entrance door of a hotel or motel room occupied by the user. The entry alarm is armed by placing the lever against the wall. In this position opening the door will cause the alarm to sound. The alarm is latched to the on position so that subsequent closing of the door will not turn off the alarm. The housing also contains a smoke alarm and detector which is placed near the ceiling of the room and will quickly detect combustion products which result from a fire in its incipient stages. The smoke alarm will sound a warning and also provide a light source visible through smoke for use by the occupant trying to find the door in a smoke filled room.

Figure 1:
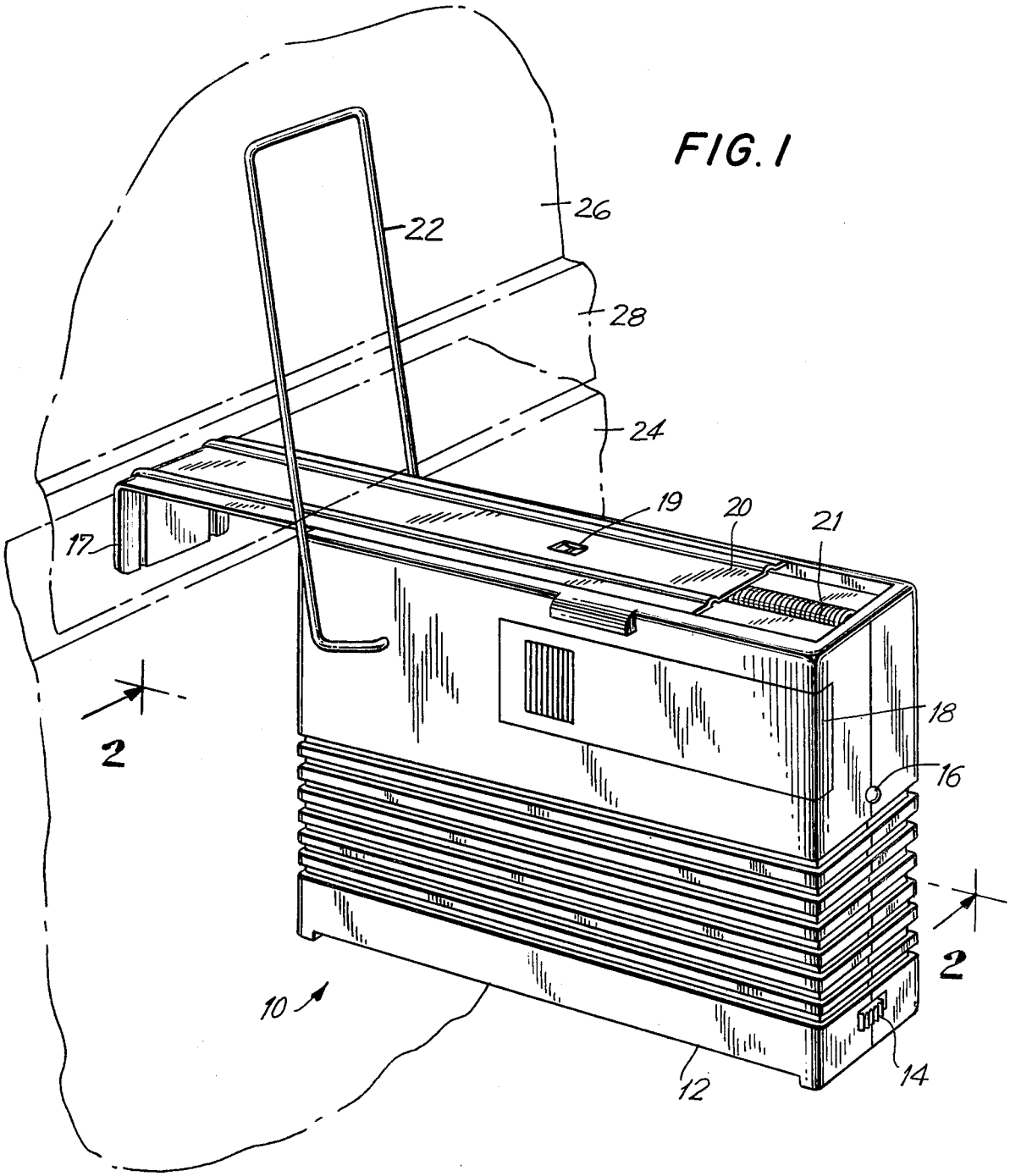
FIG. 1 is a perspective view of the present invention attached to the door.

FIG. 1 then shows a travel alarm 10 comprised of a housing 12 having a clamping means 20 at its top. The clamping means 20 is shown holding the travel alarm 10 to the top portion of a door 24. Housing 12 is clamped to the rear vertical face of the door 24 by the action of a lip 17 which engages the front vertical face of the door 24. The lip 17 is urged toward the housing 12 by a tension spring 21 affixed to an attachment point 19 found on the clamping means 20. The tension of the spring 21 holds the travel alarm 10 securely in place.

When placing the travel alarm 10 on the door 24 a lever 22 is adjusted so as to rest against a wall 26 when the door 24 is closed against a jamb 28. Generally there is sufficient clearance between the jamb 28 and the door 24 to accommodate the clamping lip 17 of means 20. Also seen in FIG. 1 is a battery cover 18, a light emitting diode LED 16 and an on-off switch 14. The aforementioned items will become more relevant as the description of the figures proceeds.

Figure 2:
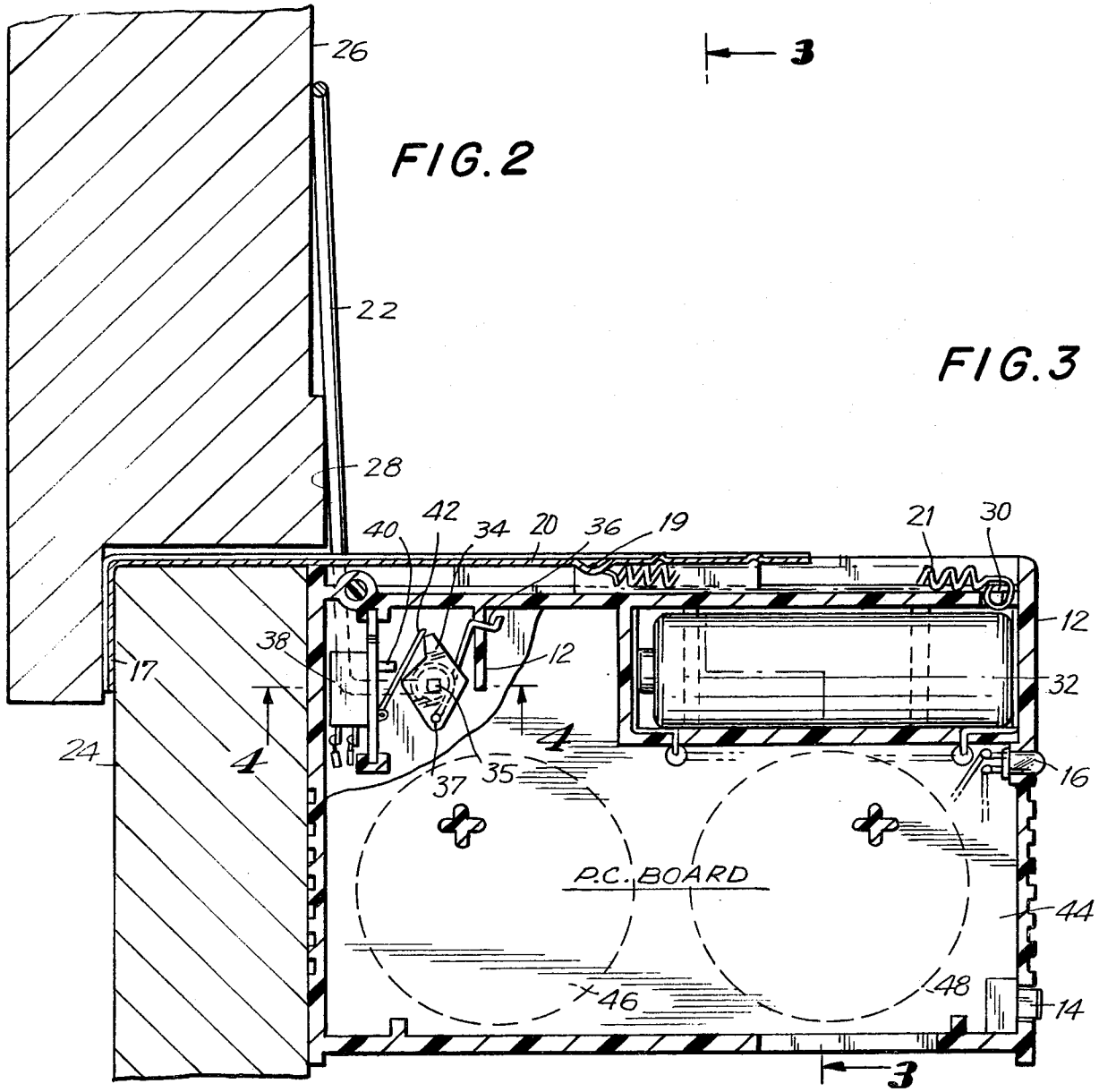
FIG. 2 is a sectional view of FIG. 1 along line 2—2.

FIG. 2 is a section taken through 2—2 of FIG. 1 and viewed in the direction of arrows 2—2. FIG. 2 shows details of the clamping means 20. Illustrated is the manner in which the housing 12 is held against the rear vertical face of the door 24 by the clamping action of the lip 17 against the front vertical face of the door 24. The clamping action of the lip 17 is furnished by the tension spring 21 which is attached to the clamping means 20 at the attachment point 19. The other end of the tension spring 21 is attached to an anchor point 30 which is part of the housing 12 (FIG. 2).

The lever 22 is kept pressed against the wall 26 by a torsion spring 36 which is coiled around a shaft 35, which is the shaft about which the lever 22 pivots. Mounted on the shaft 35 is a cam 34 having a hole 37 into which one end of the torsion spring 36 is anchored. The other end of the torsion spring 36 is anchored to the housing 12. The cam 34 is shown in contact with an actuating lever 42 of microswitch 38. Actuating lever 42 is arranged to depress the microswitch's switch plunger 40.

Further, a battery 32 is shown in the compartment which is part of the housing 12. The section 2—2 also shows a printed circuit board 44 which contains the electronics which enable the travel alarm 10 to function. Shown in outline form on the printed circuit board 44 is a smoke detector 46 and a horn 48.

Figure 3:
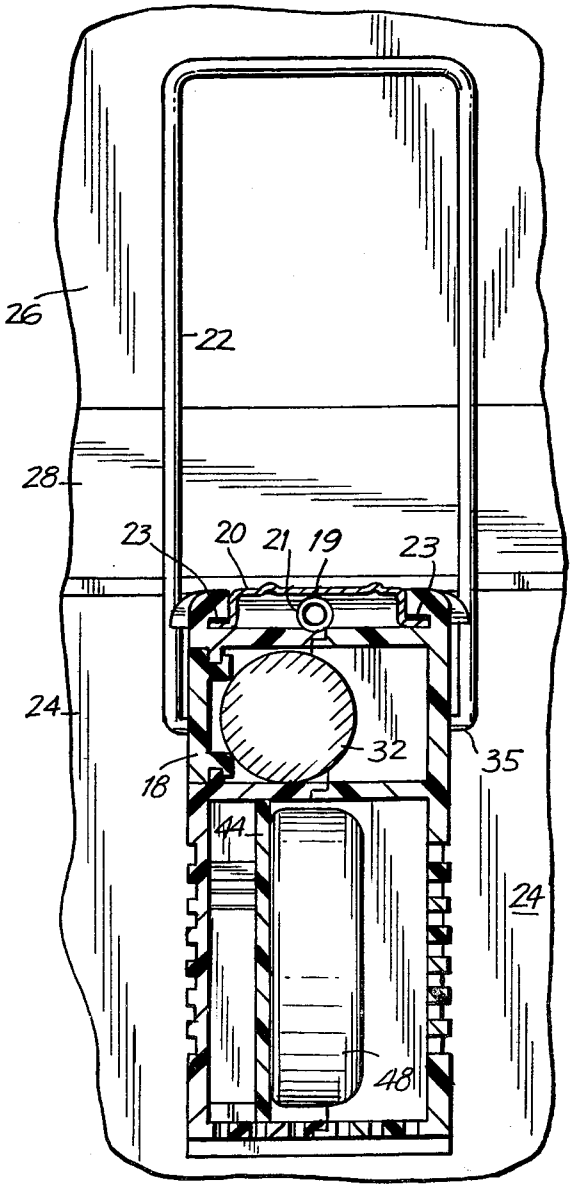
FIG. 3 is an end sectional view of FIG. 2.
Figure 4:
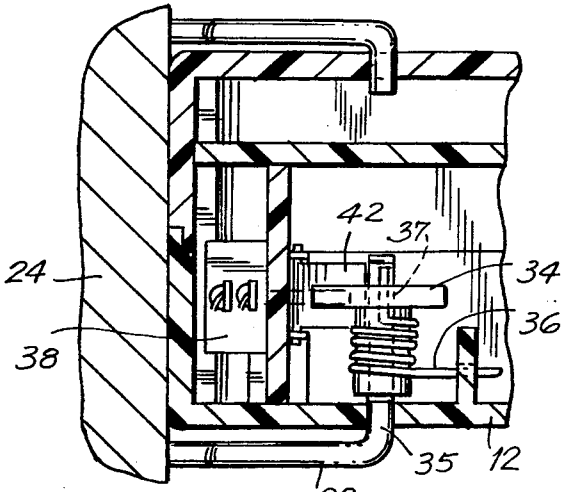
FIG. 4 is a section taken through 4—4 of FIG. 3.

FIG. 3 shows the section resulting from that taken through 3—3 of FIG. 2 and viewed in the direction of arrows 3—3. Shown here is the housing 12 together with the compartment for the battery 32. What can also be seen is the battery cover 18, the printed circuit board 44. FIG. 4 shows the shaft 35 entering the housing 12 and the lever 22 of which the shaft 35 is part. In FIG. 3, the lever 22 is seen to be resting against the wall 26, while the housing 12 is clamped to the top of the door 24. The clamping means 20 is seen to fit between the door jamb 28 and the top of the door 24. Additionally, this FIG. 3 shows a cross section of the clamping means 20 and illustrates how the clamping means 20 is guided by a pair of grooves 23. Also shown is the tension spring 21 and the attachment point 19.

FIG. 4 shows the section taken through 4—4 of FIG. 2, viewed in the direction of arrows 4—4. Seen here is the torsion spring 36 mounted coaxial with the shaft 35. One end of the torsion spring 36 is anchored onto the housing 12 and the other end is anchored to cam 34 via hole 37. The cam 34 is shown contacting the actuating lever 42 which is part of the micro switch 38. The housing 12 is seen to be in contact with the door 24.

Figure 5:
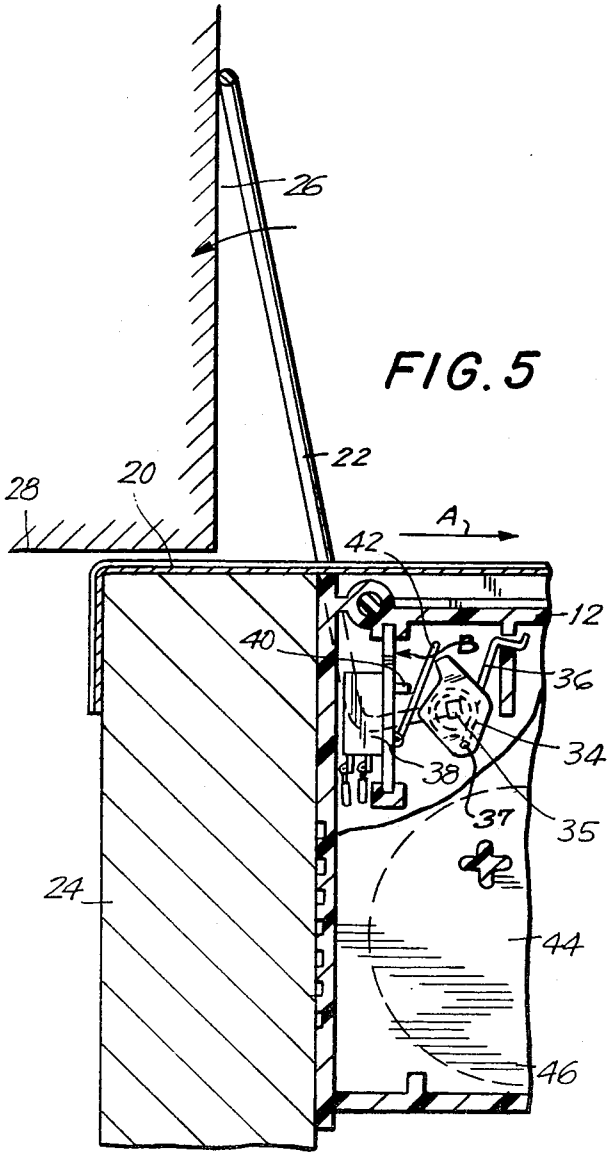
FIG. 5 is a sectional detail of FIG. 2.

FIG. 5 which is a partial portion of section 2—2 shows the door 24 in a partially opened position. For greater clarity the door jamb 28 and the wall 26 are also shown. The clamping means 20 is seen holding the housing 12 against the door 24. What is of interest here is that as the door 24 moves in the direction of the arrow B, the cam 34 is urged by the torsion spring 36 to depress the actuating lever 42 and the switch plunger 40, thereby closing the micro switch 38. The printed circuit board 44 has been partially cut-away in this FIG. 5 as well as the previous FIG. 2 in order to allow the cam 34 mechanism to be seen clearly.

Figure 6:
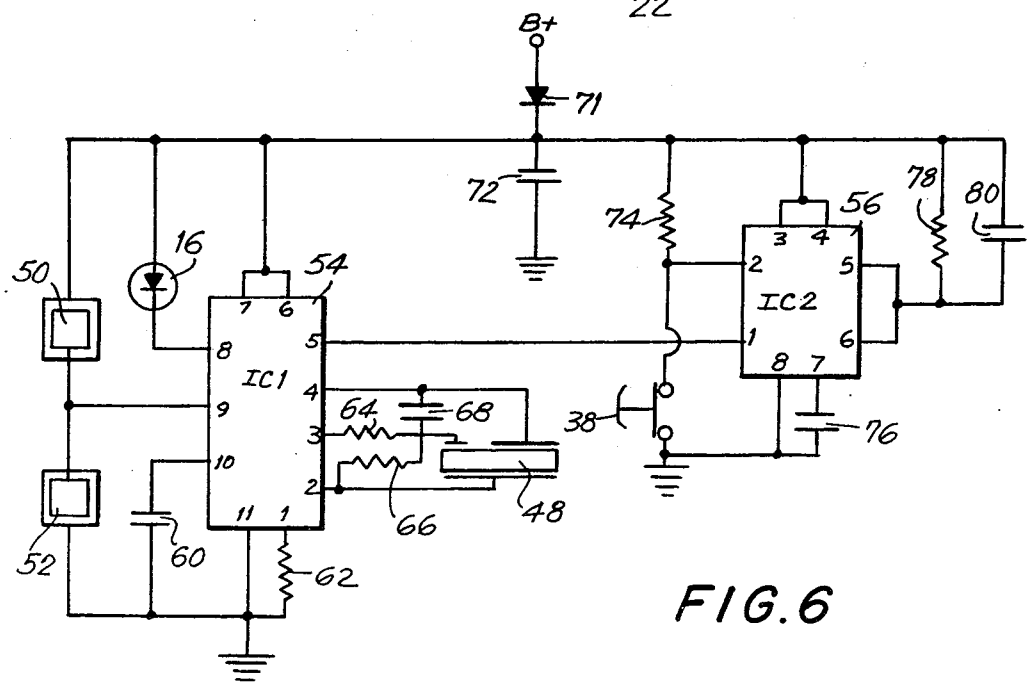
FIGS. 6 is a schematic of the present invention.

FIG. 6 is a schematic diagram of the electronic portion of the travel alarm 10. The major parts of the travel alarm 10 are an outer portion 50 and an inner portion 52 which together comprise the smoke detector 46. A first integrated circuit (IC) 54 and a second integrated circuit (IC) 56 are also major portions of the travel alarm 10 as is the horn 48. The battery voltage marked B+ is supplied through a diode 71 to power the travel alarm 10. A third capacitor 72 serves to smooth transient voltage fluctuation. The B+ voltage is applied to the outer portion 50 of the smoke detector 46 and hence to the inner portion 51 of the smoke detector 46 and then to ground, ground being the equivalent of B−. The integrated circuit 54 is designed to operate with the smoke detector 46. The common connection between the outer portion 50 and the inner portion 52 is connected to pin 9 of the first I.C. 54. A light emitting diode (LED) 16 is connected between B+ and pin 8 of the first I.C. 54. Pins 6 and 7 are both connected to the B+ portion. Pin 10 is connected to one end of a first capacitor 60, the other connected to ground. Pin 11 of the first I.C. 54 is connected to ground. A first resistor 62 is connected to pin 1 and the other end is connected to ground.

Horn 48 is shown schematically as an electrostatic device having three connections. The bottom connection being directly connected to pin 2 of the first I.C. 54. Pin 4 of the first I.C. is connected to a second capacitor 68 in series with a third resistor 66 which is connected to pin 2 of the first I.C. 54. Pin 4 of first I.C. 54 is also connected to the right top connection of the horn 48. The left top connection to horn 48 is connected to pin 3 of the first I.C. 54 by means of a second resistor 64.

Pin 5 of the first I.C. 54 is an input which is connected to pin 1 of the second I.C. 56, pin 1 being an output from I.C. 56. Second I.C. 56 is powered through pins 3 and 4 connected to the B+ power supply. Pin 8 of the second I.C. 56 is connected to ground and pin 7 is connected to ground by means of a fourth capacitor 76. Pins 5 and 6 of the second I.C. are connected together and connect to the B+ power supply by means of the parallel combination of a fifth resistor 78 and a fifth capacitor 80. The micro switch 38 has one of its contacts connected to ground and the other of its contacts connected to pin 2 of the second I.C. 56. Pin 2 of the I.C. 56 is also connected by means of a fourth resistor 74 to the B+ power supply. The foregoing completes the description of the electronic portion of the travel alarm 10.

Operation of the herein described invention will be better understood by considering the foregoing figures in conjunction with the following description. When the occupant of a hotel or motel room wishes to protect himself or herself he or she takes the travel alarm 10 of the present invention and attaches it to the top of the door 24 of the hotel room. The travel alarm 10 is designed to be mounted near the ceiling for smoke detection purposes. Mounting the travel alarm 10 on the door requires that clamping means 19 be extended and the lip 17 be placed against the opposite face of the door 24. The tension spring 21 provides sufficient force to ensure a secure clamping of the travel alarm 10. In the process of mounting the travel alarm 10 on the door 24 the lever 22 must be rotated so as to be above the housing 12, see FIGS. 1 and 2. During the preparatory stages such as described herein before the on-off switch 14 must be in the off position.

The travel alarm 10 is then armed by turning the switch 14 to the on position after it is in place on the door 28 and the door is closed. When the door is closed, a situation such as shown in FIG. 2 prevails. Here the cam 34 is just touching the actuating lever 42. When the door 24 is opened, best seen in FIG. 5, the cam 34 is rotated by the torsion spring 36 in the direction of arrow B. This movement causes switch plunger 40 of the micro switch 38 to depress and close the microswitch. This causes the second I.C. 56 to latch into an on condition. When second I.C. 56 latches into an on condition, opening the micro switch 38 by quickly closing the door 24 does not affect the latched on condition of the second I.C. 56. Only turning off the power switch 14 will cause the second I.C. 56 to reset and unlatch. The latching on of the second I.C. 56 causes an output from pin 2 of I.C. 56 to be inputed to pin 5 of the first I.C. 54. Input to pin 5 of the first I.C. 54 results in the horn 48 being energized so as to sound an alarm. The foregoing concludes the burgular alarm portion of the travel alarm 10.

The travel alarm 10 also functions as a fire detector. When products of combustion are detected by the smoke detector 46 they cause the horn 48 to sound. In this present embodiment of the invention an ionization chamber type smoke detector is used. It is possible to substitute a photo electric smoke detector or any other fire detection device can be used with the travel alarm 10 herein described. The travel alarm is located near the ceiling since products of combustion will quickly collect near the ceiling since hot air rises. The ionization detector can detect a fire before actual flames are seen.

While the present invention has been disclosed in connection with the preferred embodiment thereof, it should be understood that there may be other embodiments which may fall within the spirit, and scope of the invention as defined by the following claims.

I claim:

1. A portable alarm apparatus, comprising:

a housing having a power supply and mountable to a door;

a lever pivotably mounted about said housing and biased against a door jamb when said housing is mounted to said door;

a switch carried by said housing and actuated by pivotable movement of said lever when said door is moved from said door jamb;

smoke detection means carried by said housing;

alarm means carried by said housing for signalling movement of said door away from said door jamb and the presence of smoke; and a dual purpose detection circuit carried by said housing and operatively connected to said power supply, said detection circuit having first and second integrated circuits, said first integrated circuit connected to said second integrated circuit and said switch for enabling said second integrated circuit to activate said alarm when said switch is actuated by said lever movement and enabled said first integrated circuit, and said second integrated circuit connected to said smoke detection means and activating said alarm when said smoke detection means is actuated and enables said second integrated circuit.

2. The portable alarm apparatus of claim 1, wherein said alarm means comprises an audible signalling means.

3. The portable alarm apparatus of claim 1, wherein said alarm means comprises a visual signalling means.

4. The portable alarm apparatus of claim 1, wherein said alarm means comprises a dual purpose signalling means including both an audible and visual warning means.

5. The portable alarm apparatus of claim 1, wherein said lever is operatively connected to a rotatable cam carried by said housing, said cam rotating in response to the pivoting of said lever, said cam actuating said switch when caused to rotate.

6. The portable alarm apparatus of claim 1, wherein said detection circuit further comprises means for latching said alarm when said second integrated circuit is enabled by said first integrated circuit.

* * * * *